US006827078B2

(12) United States Patent
Price

(10) Patent No.: US 6,827,078 B2
(45) Date of Patent: Dec. 7, 2004

(54) COLLAPSIBLE WIND SHIELD AND FOOD WARMER FOR PORTABLE, RECTANGULAR, TABLETOP GAS GRILLS

(76) Inventor: Oscar Landon Price, 308 Maplewood Dr., Colorado Springs, CO (US) 80907

( * ) Notice: Subject to any disclaimer, the term of this patent is extended or adjusted under 35 U.S.C. 154(b) by 0 days.

(21) Appl. No.: 10/302,422

(22) Filed: Nov. 22, 2002

(65) Prior Publication Data

US 2004/0099258 A1 May 27, 2004

(51) Int. Cl.[7] ..... F24C 3/14; F24C 15/28

(52) U.S. Cl. ..... 126/38; 126/40; 126/50; 126/9 B

(58) Field of Search ..... 126/38, 9 B, 40, 126/50, 37 B, 25 R, 41 R, 261, 265, 9 R, 29, 30; 431/310

(56) References Cited

U.S. PATENT DOCUMENTS

| | | | | | |
|---|---|---|---|---|---|
| 1,496,344 | A | * | 6/1924 | Levinson | 126/38 |
| 2,216,147 | A | * | 10/1940 | Ward | 220/62 |
| 4,363,313 | A | * | 12/1982 | Smith | 126/9 R |
| 4,508,096 | A | * | 4/1985 | Slattery | 126/9 R |
| 4,726,349 | A | * | 2/1988 | Gehrke | 126/25 R |
| 4,838,446 | A | * | 6/1989 | Ali | 220/694 |
| 5,329,917 | A | * | 7/1994 | Young | 126/29 |
| 5,495,845 | A | * | 3/1996 | Hait | 126/9 R |
| 5,542,347 | A | | 8/1996 | Joseph | |
| 5,682,872 | A | * | 11/1997 | Whitted | 126/29 |
| 5,842,463 | A | * | 12/1998 | Hall | 126/9 R |
| 5,979,428 | A | * | 11/1999 | Greene, Jr. | 126/38 |
| 6,041,773 | A | | 3/2000 | Rosenquist | |
| 6,125,838 | A | * | 10/2000 | Hedgpeth | 126/41 R |

FOREIGN PATENT DOCUMENTS

FR 2654913 A1 * 5/1991

* cited by examiner

*Primary Examiner*—Josiah Cocks

(57) ABSTRACT

A collapsible wind shield and food warmer for portable rectangular tabletop gas grills is made of sheet metal, adjustable to fit most rectangular portable gas grills. Wind shield fits along the side of the grill between the legs and the body of the grill, with a freestanding door on one end. A sheet metal tray slides under the grill. Shield is approximately 3½" tall and 14½" long. The device deflects the wind away from underneath the grill preventing the gas burner from being blown out and increasing the inside temperature of the grill. The pan underneath the grill is used for keeping food hot, for warming buns or other foods, and for cooking on the grate. Wind shield collapses to fit inside warming pan for easy storage on the grate of the grill.

3 Claims, 6 Drawing Sheets

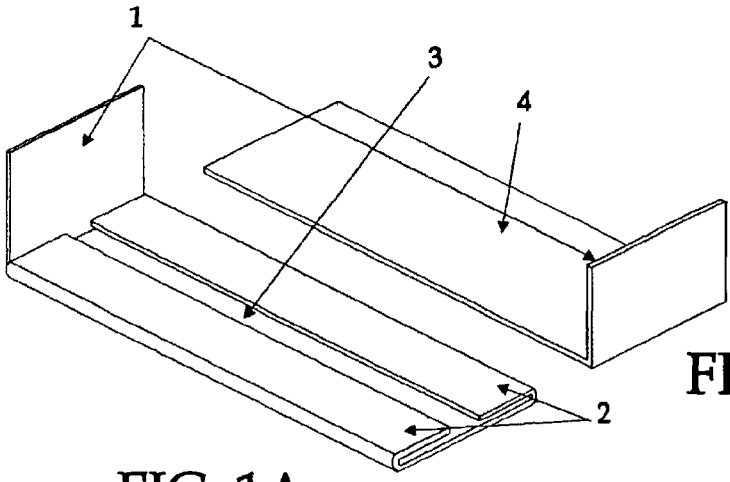
FIG. 1B
FIG. 1A
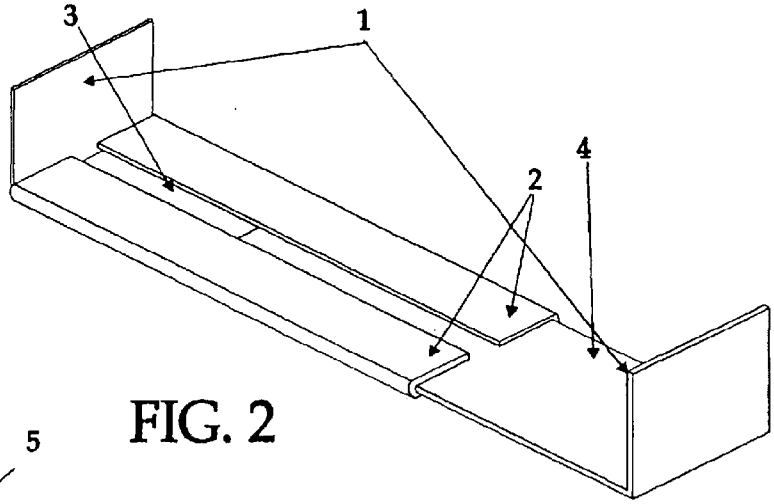
FIG. 2
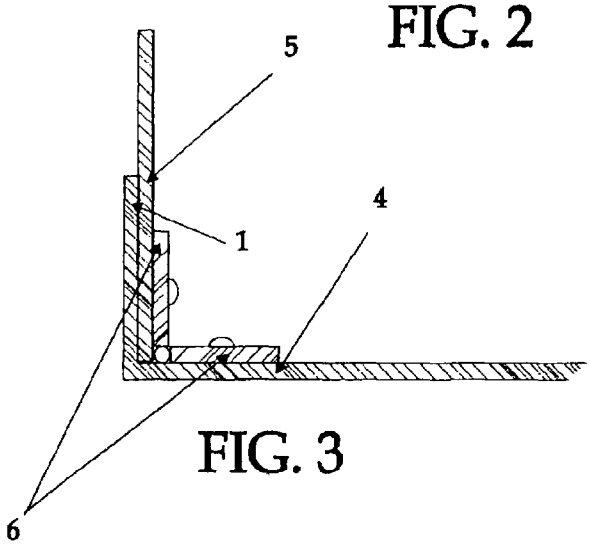
FIG. 3

COLLAPSIBLE WIND SHIELD AND FOOD WARMER FOR PORTABLE, RECTANGULAR, TABLETOP GAS GRILLS

REFERENCES CITED

| U.S. Patent Documents | | | |
|---|---|---|---|
| 4726349 | February 1988 | Gehrke | 126/25R |
| 5329917 | July 1994 | Young | 126/29. |
| 5682872 | November 1997 | Whittead | 126/29. |
| 5842463 | December 1998 | Hall | 126/9R. |
| 5979428 | November 1999 | Green, Jr. | 126/38. |
| 6125838 | October 2000 | Hedgpeth | 126/25R. |

BACKGROUND OF THE INVENTION

As more and more people go camping and fishing and barbecue in their own backyards, many cook their meals on portable tabletop gas grills. The grills being constructed today all seem to have a problem with the gas burner being blown out while cooking on a windy day due to the space between the underside of the grill and the surface on which it sits, which allows wind to blow underneath the grill. In addition to blowing the burner out, the wind decreases the heat inside the grill. Since wind seems to be a constant at outdoor cookouts, especially in campgrounds, there is a great need for a collapsible wind shield, adjustable in width, which will fit most portable rectangular gas tabletop grills to allow cooking in all weather conditions.

While there is some prior art, none was found that was designed to be used with portable rectangular gas tabletop grills, none was found designed to shield the burner of the gas grill from the sides and the end and none found is adjustable in width.

Young (U.S. Pat. No. 5,329,917—Jul. 19, 1994) designed a fire ring which encircles a campfire and holds cooking utensils above the fire. It is not designed for portable rectangular gas grills and is not practical to use therewith.

Gehrke (U.S. Pat. No. 4,726,349—Feb. 23, 1988) has designed a portable grill device which incorporates wind-guard walls. However, they are designed for use with his grill only and are not adaptable for other grill configurations.

Hall (U.S. Pat. No. 5,842,463—Dec. 1, 1998) has designed a multiple part device to constrain a campfire and hold heat beneath cooking utensils. His device employs a chimney to reduce heat loss. Again, this device is not designed for portable gas grills and would be impractical for such use.

Green, Jr. (U.S. Pat. No. 5,979,428—Nov. 9, 1999) has designed a retrofitable wind screen for round portable gas cookers. While it shields the gas flame from the wind and increases overall efficiency, while working as a safety device to keep the cooking utensil from being accidentally removed from the cooking surface, it is designed for a round cooker only, and would not be adaptable to, nor practical for, a portable rectangular gas tabletop grill.

Hedgpeth (U.S. Pat. No. 6,125,838—Oct. 3, 2000) has designed a gas grill which incorporates a series of wind resistant baffles to deflect the wind. The baffles are part of the grill and could not be adapted for portable rectangular gas tabletop grills.

The instant invention relates only to portable rectangular tabletop gas grills to provide protection from the wind and prevent the gas burner from being blown out while cooking. This invention also increases the temperature of the grilling area, which makes food cook more quickly. A warming pan, which slides under the grill, may be used to keep foods hot and to warm buns, rolls, etc. The warming pan may also be placed on the grate of the grill to use as a griddle.

BRIEF SUMMARY OF THE INVENTION

This invention consists of 2 pieces of 16 gauge aluminum sheet metal, 14½"×3½", which fit on each side of a portable tabletop grill. An adjustable center piece made up of two pieces of equal length, one with a channel into which the other slides, allows the width to expand up to 12" or more. A freestanding sheet metal door with wooden knob, 3½" tall with ½" folds on top and bottom 1½" bend at 88 degrees on the bottom edge, which is used as a stabilizing foot. Two 1½" hinges attach the center bottom of each side panel to the adjustable center pieces at the base near the 90 degree bend. An 8½"×14¾"×½" deep warming pan slides underneath the grill to keep foods hot or warm buns, rolls, etc.

BRIEF DESCRIPTION OF THE DRAWINGS

FIG. 1A shows one of the adjustable center pieces, showing a 2½" bend of 90 degrees at one end to serve as a stop for the side panels, and showing a ¾" fold on each long side to act as a track into which the piece described in 1B slides.

FIG. 1B shows the second adjustable center piece, with a 1½" bend of 90 degrees at one end to serve as a stop for the side panels, the other end of which is inserted into the track on the piece described in 1A to form the entire adjustable center piece.

FIG. 2 shows the pieces in FIG. 1A and FIG. 1B assembled.

FIG. 3 shows how the 1½" hinge is attached to the adjustable center piece and the side panel, FIG. 4.

DETAILED DESCRIPTION OF THE INVENTION

Figure 4:
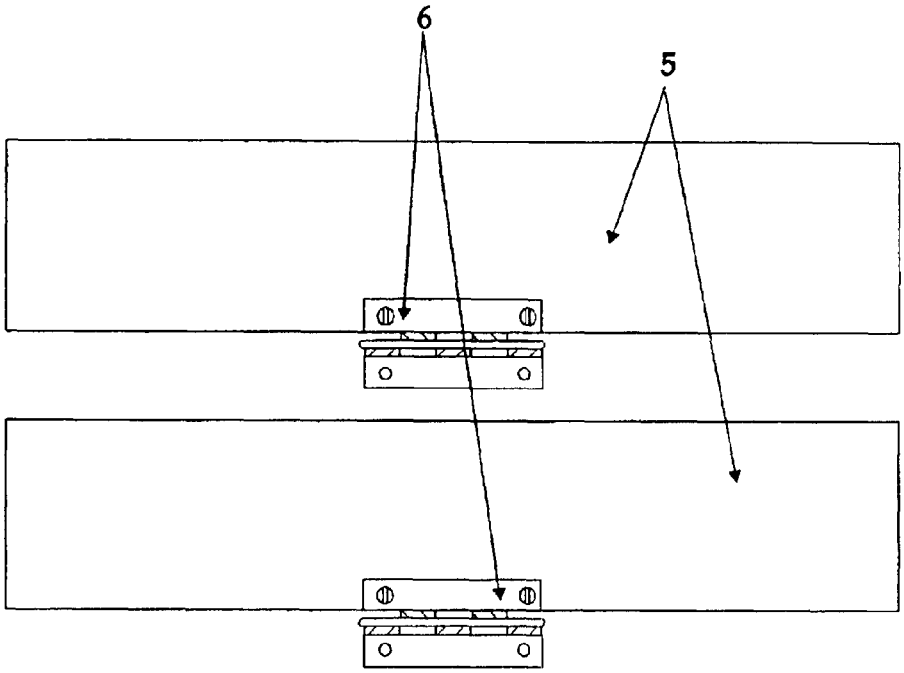
FIG. 4 shows the two side panels with 1½" hinges attached to the bottom center of each side panel. The other half of the hinge attaches to the adjustable center pieces, as shown in FIG. 3.
Figure 5:
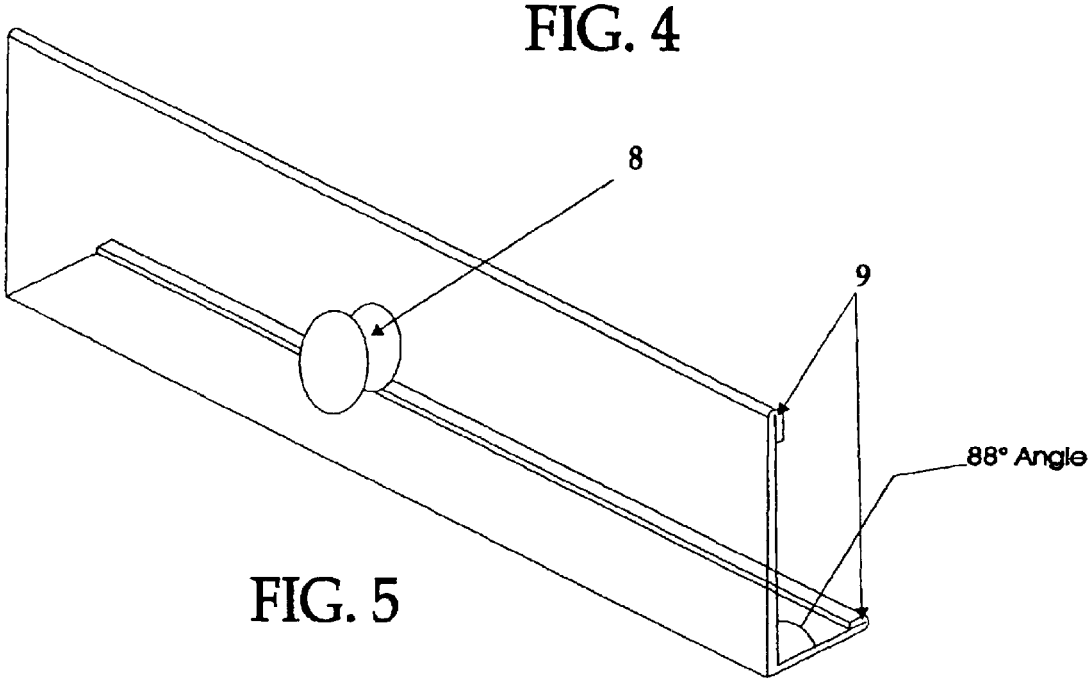
FIG. 5 shows the freestanding door with an 88 degree bend of 1½" at the bottom edge to serve as a base, and a wooden knob which serves as a handle.

Referring to FIG. 1A, a piece of sheet metal 5" wide by 8½" long is shown. The last 1½" of the 8½" length is cut out ¾" on each side. This 2½" by 3 end 1 is bent upward at 90 degrees. The ¾" on each side of the remaining 7" is folded over to form a track into which the piece described as FIG. 1B below can be inserted. One of the side panels 5 is attached to this piece by hinge 6 at the bottom center in such a manner that when the side panel 5 is raised to an upright position, the 1½" upward bend acts as a stop 1 to hold the side panel 5 in an upright position.

Referring to FIG. 1B, a piece of sheet metal 2⅞" wide by 7½' long is shown, with the last 1½" bent upward at a 90 degree angle 1. One of the side panels 5 is attached to this piece by hinge 6 at the bottom center in such a manner that when the side panel 5 is raised to an upright position, the 1½" upward bend acts as a stop 1 to hold the side panel 5 in upright position.

Referring to FIG. 2, when the pieces described in FIG. 1A and FIG. 1B are assembled as shown, the width of the wind shield can be adjusted to 12" wide or more. The inventor has determined that the vast majority of portable tabletop gas grills would only require a wind shield 10" wide. However, the ability to expand the width to 12" or more allows the instant invention to accommodate an even greater variety of grill sizes.

A hinge 6 is attached at the center of the side panels 5 at the bottom edge and to the adjustable center pieces 3, 4 at the 90 degree upward bend used as a stop 1.

The 3½"×14½" side panels 5, made of 16 gauge sheet aluminum, are attached to the adjustable center pieces described as FIG. 1A and FIG. 1B with a 1½" hinge 6 located in the center of each panel 5 and attached in such a way as to allow the panels to fold down flat. When the side panels 5 are raised to form the wind shield, the 1½" upturned ends on the adjustable center pieces act as stops 1 to keep the side panels 5 from folding outward. When adjusted snugly against the side of the grill inside the grill legs, the grill itself prevents the shield from folding inward.

Sheet aluminum is the preferred material because it is food safe and does not emit toxic fumes when heated, as some other metals do, e.g., galvanized sheet metal. Aluminum is also lightweight for shipping or carrying, and is durable. Stainless steel and other metals could be used as long as they are food safe.

The freestanding door 7 is also made of 16 gauge sheet aluminum. It is 3½" tall and 12" wide with ½" folds 9 on the top and bottom edges, and a 1½" bend at 88 degrees on the bottom edge to act as a base. The 88 degree bend of the base allows it to lean slightly toward the grill and keeps the door standing upright. The base of the door slides underneath the side panels 5 at the end of the grill opposite the gas regulator. The door 7 is fitted with a wooden knob 8 attached with a screw. This completes the wind shield.

Figure 6:
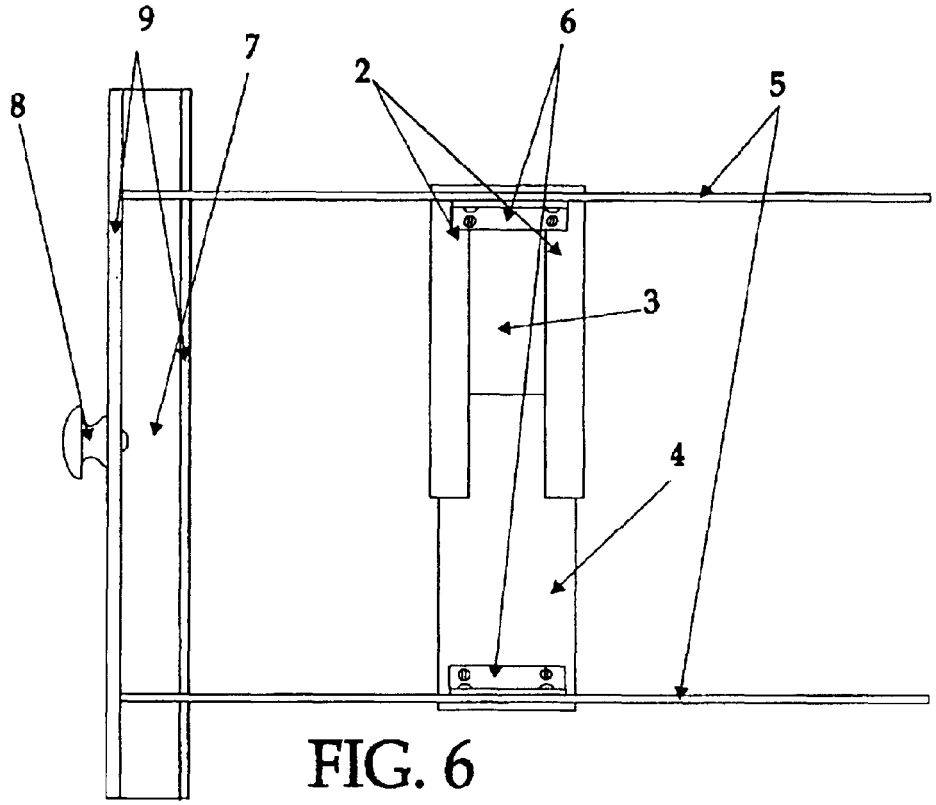
FIG. 6 shows wind shield completely assembled without the warming pan, FIG. 8B.
Figure 7:
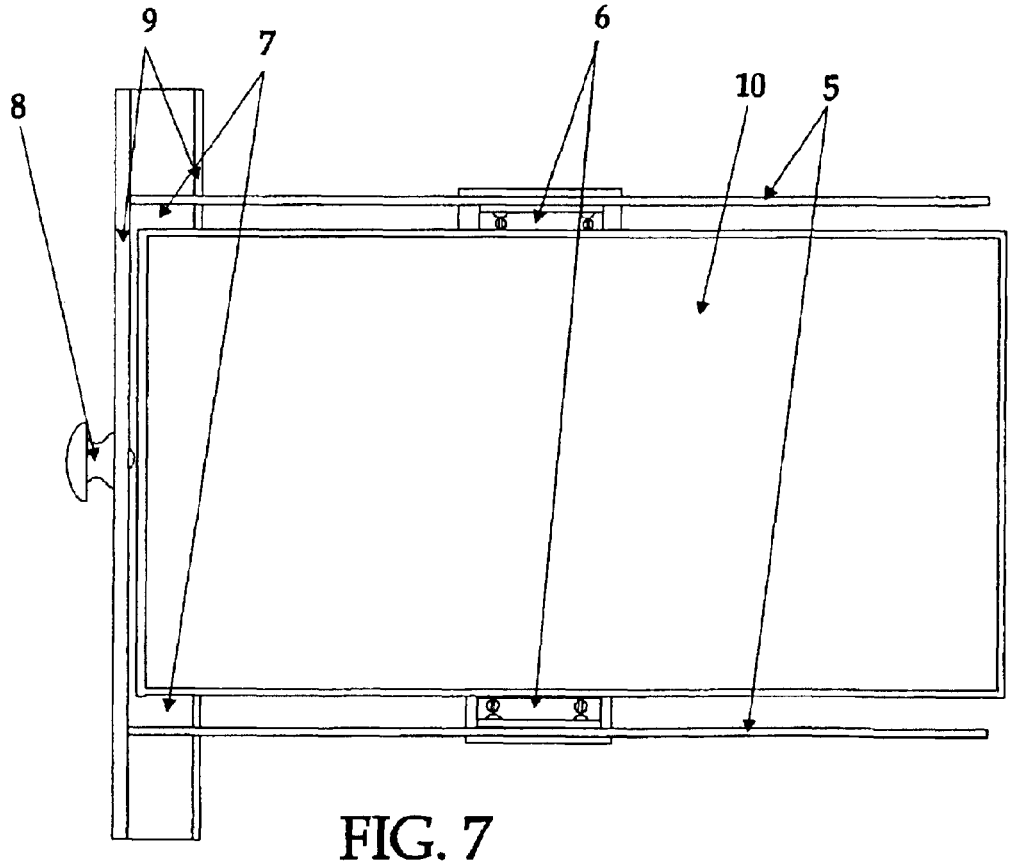
FIG. 7 shows wind shield completely assembled with the warming pan, FIG. 8B, in place.

In FIG. 6, the wind shield is shown completely assembled off the grill with the door 7 in place and FIG. 7 shows the wind shield completely assembled off the grill with the door 7 and the warming pan 10 in place.

Figure 8C:
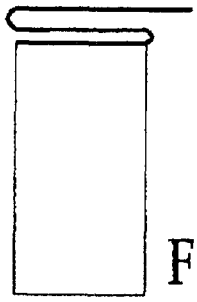
FIG. 8C shows a side view of the end of the warming pan, showing the folds necessary to form the legs of the pan.
Figure 8A:
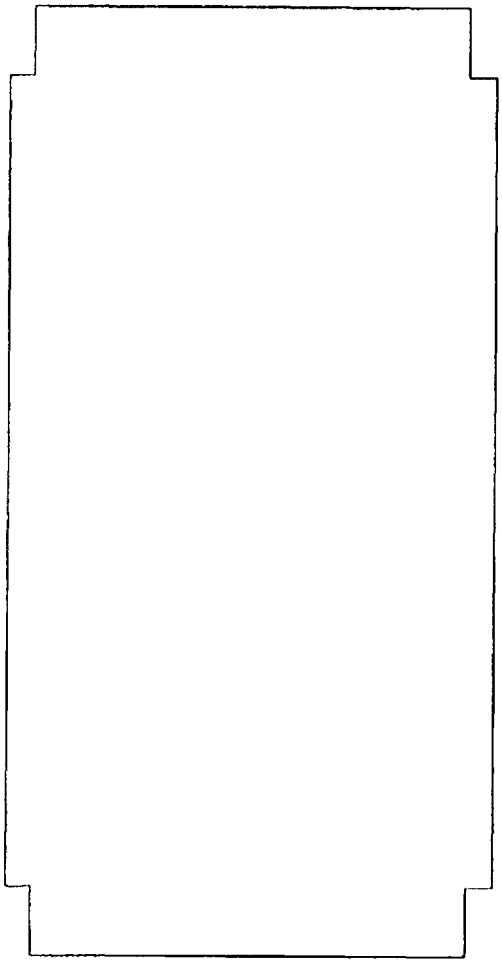
FIG. 8A shows the layout of the sheet metal comprising the pan prior to the folds being made.
Figure 8B:
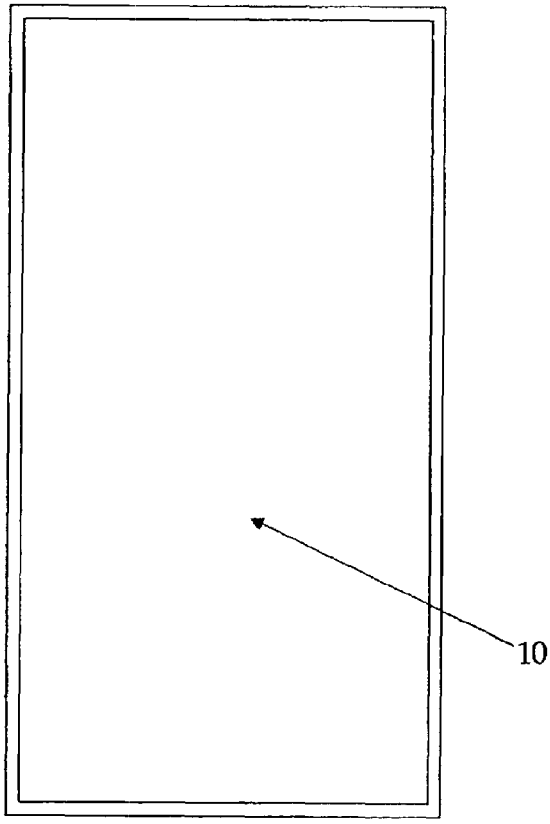
FIG. 8B shows the warming pan, 8½" wide by 14¾" long by ½" deep, with ¼" legs on each end.

The warming pan, FIG. 8B, can be inserted beneath he grill between the side panels 5. FIG. 8A shows how the pan is formed using a piece of sheet aluminum 9½"×17¼" with the last 1¼" of both ends of each side is cut out to a depth of ½". The long edge is then folded upward ½" on each side. When the 1¼" ends are folded upward 1¼" and then back down ¾" as shown in FIG. 8C, ¼" legs are formed on the ends of the pan. This allows air to circulate between the pan and the surface on which it sets and prevents scorching the surface. FIG. 8C shows a side view of how the legs are formed.

The warming pan may also be placed on the grate of the grill to be used as a griddle for cooking a large variety of foods.

Figure 9:
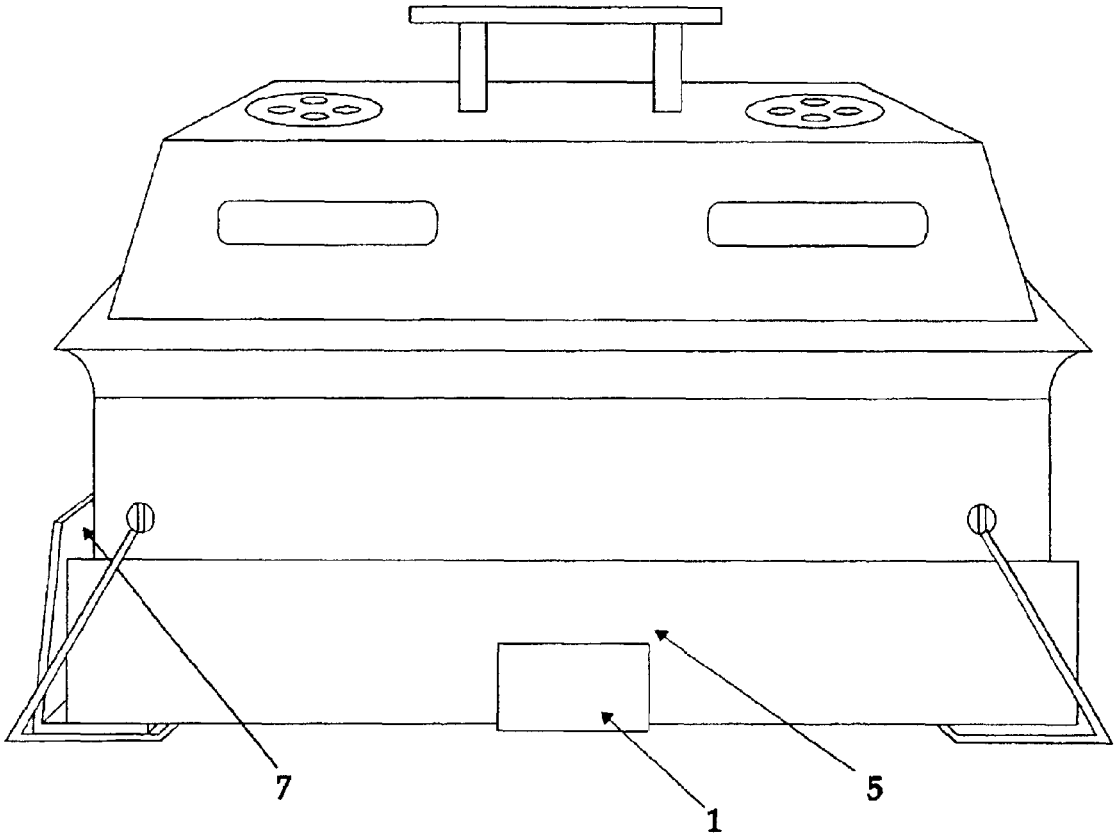
FIG. 9 shows the wind shield completely assembled around a portable tabletop gas grill.

When the wind shield is completely assembled around the grill, FIG. 9, the gas burner is shielded from the wind on both sides and the end opposite the gas regulator. While the wind shield is not completely airtight, it is very effective in keeping the wind from blowing out the gas burner. However, it may be worth noting that in very strong winds, the grill should be oriented with the gas regulator end away from the wind.

Figure 10:
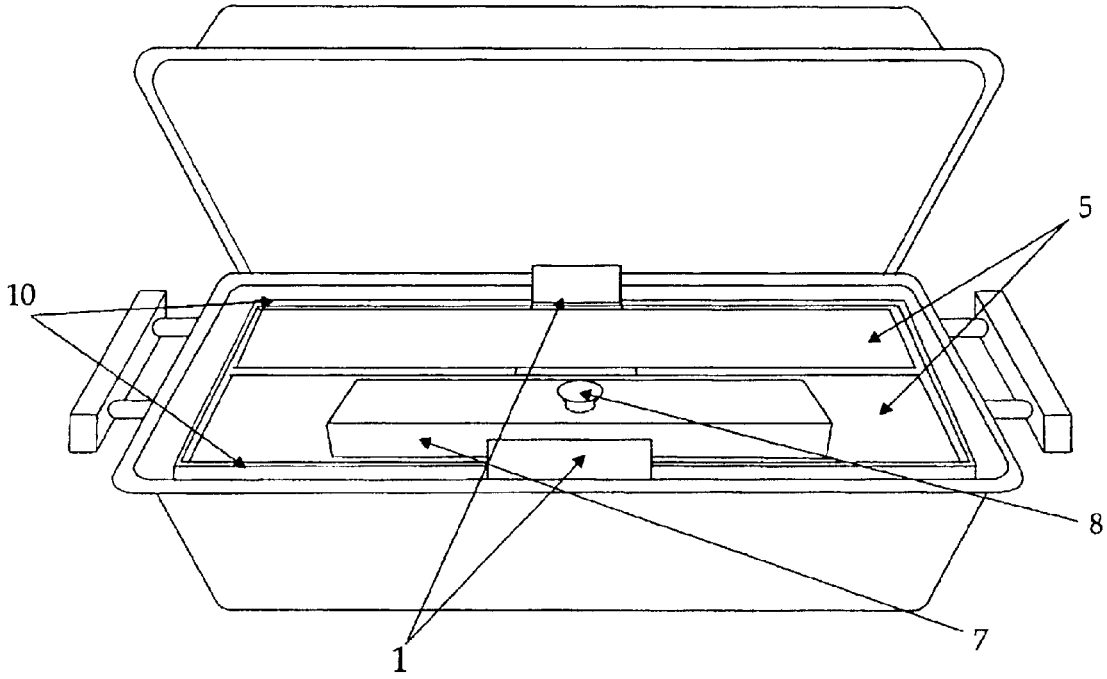
FIG. 10 shows the wind shield collapsed and placed in the warming pan stored on top of the grate inside the grill.

The use of this wind shield gives an added dimension to outdoor cooking, especially on windy days. The wind shield also helps hold heat inside the grill, which allows food to be cooked more quickly, at a higher temperature and using less gas When the wind shield is collapsed as shown in FIG. 10, it is designed to fit inside the warming pan 10 and be stored on the grate inside the grill. This is a great convenience since the wind shield stays with the grill and always at hand to be used No tools are required to assemble the wind shield. The side panels 5 are raised to their upright position and the wind shield is slid under the grill, with the wind shield sitting on the grill legs where the grill legs fold under the grill, and the side panels 5 between the legs and the body of the grill on each side, FIG. 9. The side panels 5 are pushed together until they fit snugly against the body of the grill. The base of the door 7 is then slid under the ends of the side panels 5 against the body of the grill at the end opposite the gas regulator.

I claim:

1. A collapsible wind shield and food warmer for portable, rectangular tabletop gas grills, comprising:

(a) two flat panels of sheet metal having top and bottom edges, and having the length and height to accommodate the opening of each side of most portable rectangular tabletop gas grills;

(b) a means of attaching hinges to each flat panel by having two holes at the center bottom edge to accommodate the eyes of the hinges, and a means for attaching the flat panels by rivets or other means;

(c) two adjustable center pieces, made of sheet metal, the first of which has folds on each edge to establish a track thereon into which the second piece may be inserted;

(d) each adjustable center piece has a 90 degree bend at one of its ends which extends vertically 1½" forming a stop thereon which prevents the flat panels from leaning away from the grill and keeps the flat panels in an upright position;

(e) two holes located on each end of the adjustable center pieces near the 90 degree bend of the stop allows half of each hinge to be attached to that portion of the adjustable center piece by rivets or other means;

(f) a freestanding door, finished size 3½" high ×12" wide, made of 16 gauge sheet metal 6" high ×12" wide, having ½" folds at the top and bottom edges of the 6" height,and an additional 1½ " bend of 88 degrees at the bottom edge which acts as a base to keep the door standing upright and leaning slightly towards the grill, and a wooden knob is attached to the face of the door with a screw to serve as a handle.

2. A collapsible wind shield and food warmer for portable, rectangular tabletop gas grills as recited in claim 2 further comprising a warming pan made of food safe sheet metal that can be inserted underneath the grill between the side panels of the wind shield, or placed on the grate of the grill to cook on, and designed in such a way that the ends of the pan form ¼" legs to allow air circulation beneath the pan.

3. A collapsible wind shield as described in claim 2 wherein the wind shield can be folded flat when not in use and conveniently stored in the warming pan on the grate inside the grill.

* * * * *